US006712459B2

(12) United States Patent
Petranek

(10) Patent No.: US 6,712,459 B2
(45) Date of Patent: Mar. 30, 2004

(54) INK CARTRIDGE HAVING SHIELDED POCKET FOR MEMORY CHIP

(75) Inventor: Diana C. Petranek, Hilton, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/198,511

(22) Filed: Jul. 18, 2002

(65) Prior Publication Data

US 2004/0012656 A1 Jan. 22, 2004

(51) Int. Cl.[7] ..... B41J 2/175

(52) U.S. Cl. ..... 347/86

(58) Field of Search ..... 347/19, 85, 86, 347/87

(56) References Cited

U.S. PATENT DOCUMENTS

| | | | | |
|---|---|---|---|---|
| 4,183,031 | A | | 1/1980 | Kyser et al. |
| 4,506,276 | A | | 3/1985 | Kyser et al. |
| 4,853,708 | A | | 8/1989 | Walters |
| 4,907,019 | A | | 3/1990 | Stephens |
| 4,961,088 | A | | 10/1990 | Gilliland et al. |
| 5,138,344 | A | | 8/1992 | Ujita |
| 5,221,935 | A | * | 6/1993 | Uzita ..... 347/86 |
| D341,157 | S | | 11/1993 | Kitahara et al. |
| 5,266,968 | A | | 11/1993 | Stephenson |
| 5,293,913 | A | | 3/1994 | Preszler |
| 5,406,320 | A | | 4/1995 | Durst et al. |
| 5,408,746 | A | | 4/1995 | Thoman et al. |
| 5,410,641 | A | | 4/1995 | Wakabayashi et al. |
| 5,506,611 | A | | 4/1996 | Ujita et al. |
| 5,519,422 | A | | 5/1996 | Thoman et al. |
| 5,530,531 | A | | 6/1996 | Girard |
| 5,552,816 | A | | 9/1996 | Oda et al. |
| 5,561,450 | A | | 10/1996 | Brewster, Jr. et al. |
| 5,610,635 | A | | 3/1997 | Murray et al. |
| 5,666,146 | A | | 9/1997 | Mochizuki et al. |
| 5,691,753 | A | | 11/1997 | Hilton |
| 5,710,579 | A | | 1/1998 | Hahs et al. |
| 5,721,576 | A | | 2/1998 | Barinaga |
| 5,745,137 | A | | 4/1998 | Scheffelin et al. |
| 5,751,322 | A | | 5/1998 | Miller et al. |
| 5,788,388 | A | | 8/1998 | Cowger et al. |
| 5,825,387 | A | | 10/1998 | Cowger et al. |
| 5,825,388 | A | | 10/1998 | Sasaki |
| 5,835,817 | A | | 11/1998 | Bullock et al. |
| 5,860,363 | A | | 1/1999 | Childers et al. ..... 347/85 |
| 5,861,897 | A | * | 1/1999 | Ide et al. ..... 347/86 |
| 5,880,764 | A | | 3/1999 | Barinaga |
| 5,920,333 | A | | 7/1999 | Bates |
| 5,956,057 | A | | 9/1999 | Childers et al. |
| 5,959,647 | A | | 9/1999 | Claramunt et al. |
| 6,000,773 | A | | 12/1999 | Murray et al. |

(List continued on next page.)

FOREIGN PATENT DOCUMENTS

| | | |
|---|---|---|
| DE | 3405164 A1 | 8/1985 |
| EP | 0 940 258 | 9/1999 |
| EP | 1 092 546 | 4/2001 |
| EP | 1 281 523 | 2/2003 |
| JP | 359-214656 | 12/1984 |
| JP | 363-004953 | 1/1988 |
| WO | 99 44830 | 9/1999 |

OTHER PUBLICATIONS

U.S. patent application Ser. No. 2002/024571, Childers et al., filed Feb. 28, 2002.

*Primary Examiner*—Thinh Nguyen
*Assistant Examiner*—Julian D. Huffman
(74) *Attorney, Agent, or Firm*—Roger A. Fields

(57) ABSTRACT

An ink cartridge includes a housing with an integral pocket, an ink supply bag contained in the housing, and a memory chip supported in a wall opening of the pocket. The housing has an ink blocking shield arranged at a location between the bag and the memory chip to prevent any ink that might leak from the bag from entering the wall opening and contaminating the memory chip.

10 Claims, 4 Drawing Sheets

U.S. PATENT DOCUMENTS 6,003,985 A 12/1999 Bekki
6,019,449 A 2/2000 Bullock et al.
6,059,403 A 5/2000 Burgin
6,065,826 A 5/2000 Robinson et al.
6,102,533 A 8/2000 Nozawa et al.
6,130,695 A 10/2000 Childers et al.
6,151,039 A 11/2000 Hmelar et al.
6,155,678 A 12/2000 Komplin et al.
6,164,743 A 12/2000 Hmelar et al.
6,168,262 B1 1/2001 Clark et al.
6,183,077 B1 2/2001 Hmelar et al.
6,199,973 B1 3/2001 Bartolome et al.
6,199,977 B1 3/2001 Komplin et al.
6,203,147 B1 3/2001 Battey et al.
6,209,996 B1 4/2001 Gasvoda et al.
6,227,638 B1 5/2001 Childers et al.
6,227,643 B1 5/2001 Purcell et al.
6,227,663 B1 5/2001 Santhanam et al.
6,243,116 B1 6/2001 Kotaki et al.
6,416,166 B1 * 7/2002 Robinson et al. ..... 347/86
6,502,917 B1 * 1/2003 Shinada et al. ..... 347/86
6,505,926 B1 * 1/2003 Trafton et al. ..... 347/85
6,547,363 B1 * 4/2003 Shinada et al. ..... 347/85
6,554,411 B1 * 4/2003 Hatasa et al. ..... 347/86

* cited by examiner

INK CARTRIDGE HAVING SHIELDED POCKET FOR MEMORY CHIP

CROSS REFERENCE TO RELATED APPLICATIONS

Reference is made to commonly assigned, U.S. Pat. No. 6,554,412 entitled INK CARTRIDGE WITH COLOR DISCRIMINATION STRUCTURE and filed Aug. 16, 2001 in the names of Trafton, Newkirk, and Robinson; U.S. Pat No. 6,416,166 entitled INK CARTRIDGE WITH ALIGNMENT FEATURES AND METHOD OF INSERTING CARTRIDGE INTO A PRINTER RECEPTACLE and filed Aug. 16, 2001 in the names of Trafton, Newkirk, Robinson, and Gotham; U.S. Pat. No. 6,505,926 entitled INK CARTRIDGE WITH MEMORY CHIP AND METHOD OF ASSEMBLING and filed Aug. 16, 2001 in the names of Trafton, Newkirk, and Robinson, and U.S. Pat. No. 6,536,888 entitled INK CARTRIDGE WITH INTERNAL INK BAG AND METHOD OF FILLING and filed Aug. 16, 2001 in the names of Trafton, Farnung, and Petranek.

All of the cross-referenced applications are incorporated into this application.

FIELD OF THE INVENTION

The invention relates generally to ink cartridges for ink jet printers, and in particular to an ink cartridge that includes a pocket for a memory chip.

BACKGROUND OF THE INVENTION

The cross-referenced U.S. Pat. No. 6,505,926 entitled INK CARTRIDGE WITH MEMORY CHIP AND METHOD OF ASSEMBLING, disclose an ink cartridge that includes a pocket for a memory chip.

The disclosed ink cartridge includes a pair of housing portions with respective pocket portions including wall opening portions, an ink supply bag contained in the housing portions, and a memory chip supported in the wall opening portions. The housing portions mate to form a cartridge housing with the pocket portions forming a single pocket including the wall opening portions forming a single wall opening.

If per chance any ink leaks from an ink supply bag in the cartridge housing, it can enter the wall opening portions and contaminate a memory chip supported in the single pocket.

SUMMARY OF THE INVENTION

According to one aspect of the invention, an ink cartridge comprising a housing with an integral pocket including a wall opening, an ink supply bag contained in the housing, and a memory chip supported in the wall opening, is characterized in that:

the housing has an ink blocking shield arranged at a location between the bag and the memory chip to prevent any ink that might leak from the bag from entering the wall opening and contaminating the memory chip.

According to another aspect of the invention, a method of assembling an ink cartridge to include a memory chip in a single pocket comprises:

providing a pair of housing portions with respective pocket portions including wall opening portions and with respective ink blocking shield segments extending across the wall opening portions at inner sides of the housing portions;

mating the housing portions to form a cartridge housing with the pocket portions forming a single pocket including the wall opening portions forming a single wall opening and the ink blocking shield segments abutting edge-to-edge to seal the single wall opening; and including a memory chip in the single pocket as the single pocket is formed.

According to another aspect of the invention, a pair of housing halves for containing an ink supply bag and provided with respective pocket portions including wall opening portions for a memory chip, are characterized in that:

the housing halves have respective ink blocking shield segments that extend across the wall opening portions at inner sides of the housing halves to prevent any ink that might leak from an ink bag contained in the housing halves from entering the wall opening portions and contaminating a memory chip supported in the wall opening portions.

DETAILED DESCRIPTION OF THE INVENTION

Figure 1:
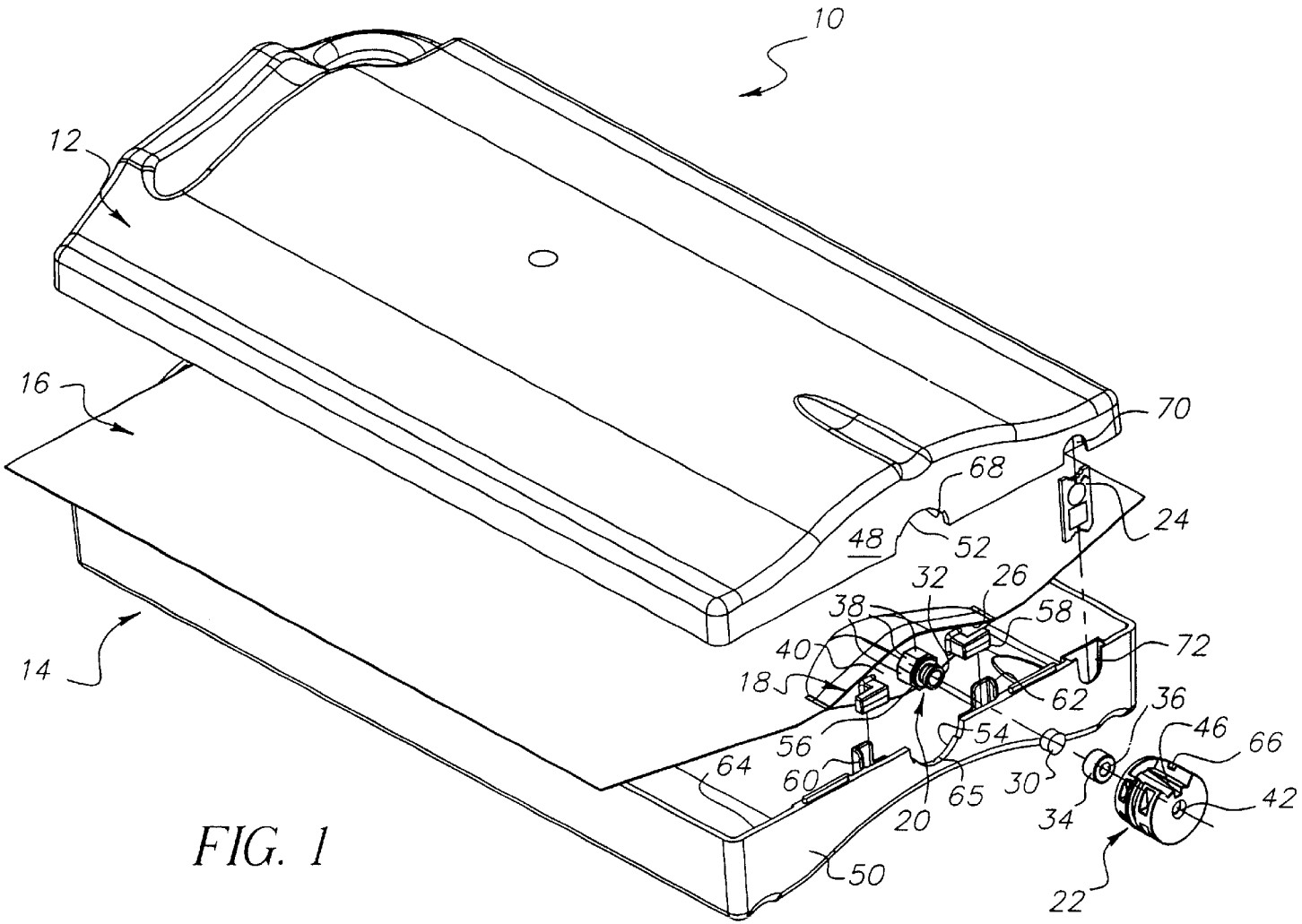
FIG. 1 is an exploded perspective view of an ink cartridge according to a preferred embodiment of the invention.

Referring now to the drawings, FIGS. 1–6 show an ink cartridge 10 for an ink jet printer (not shown). The cartridge includes the following components:

a pair of plastic housing halves 12 and 14 that mate or connect to form a cartridge housing;

a disposable flexible ink supply bag 16;

a plastic connector-fitting or fitment 18 having an integral ink egress snout 20 for discharging an ink supply from the bag 16;

a plastic single-part collar 22 for the snout 20, which functions as an ink identifier to identify the ink supply in the bag 16 such as by color or type; and a memory chip 24.

Figure 3:
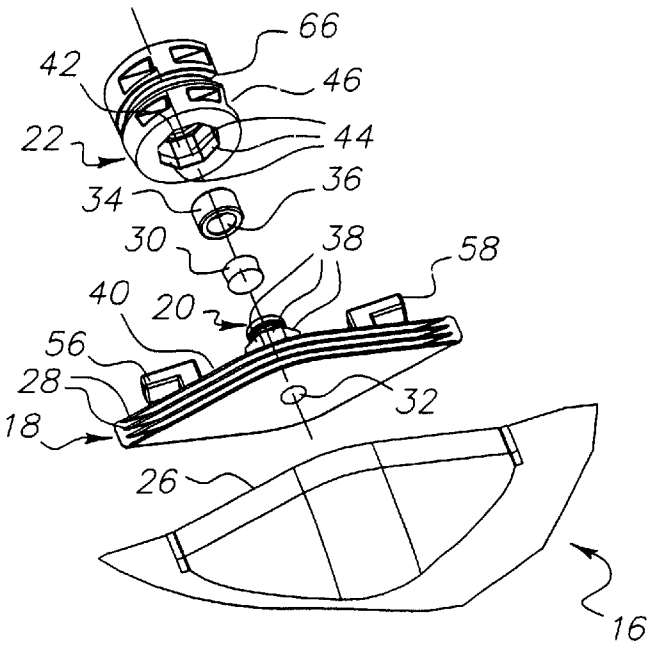
FIGS. 2 and 3 are exploded perspective views of an ink egress snout and a collar in the ink cartridge as shown from opposite views.
Figure 2:
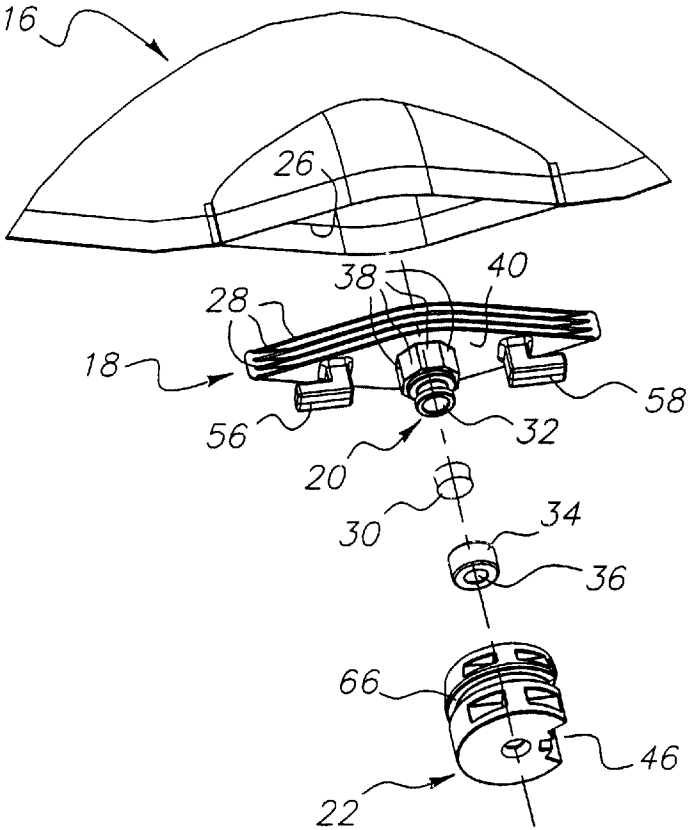

As shown in FIGS. 2 and 3, the fitting 18 is attached via a thermal seal to the bag 16, within an elongate opening 26 in the bag. During the thermal seal of the bag 16 to the fitting 18, a small amount of melted material from the bag flows to between parallel ribs 28 along opposite longitudinal sides of the fitting 18 to provide an essentially leak-proof seal between the bag and the fitting. A rubber septum 30 is tightly inserted into an ink egress opening 32 in the snout 20 to plug the opening. Then, an aluminum or stainless steel cap 34 is press-fitted on the snout 20. The cap 34 partially overlaps the septum 30 to capture the septum, and has a center opening 36 which allows a hollow needle (not shown) to pierce the septum in order to discharge an ink supply from the bag 16 when the cartridge 10 is used in an ink jet printer.

The snout 20 has eight identical outer peripheral surfaces (sides) or facets 38 that project perpendicular from a longitudinal planar face 40 of the fitting 18 to form an octagon.

See FIGS. 2 and 3. In a similar sense, the collar 22 has a center opening 42 that is circumscribed by eight identical inner peripheral surfaces (sides) or facets 44 that form an octagon. This mutual or complementary configuration allows the snout 20 to be received in the center opening 42 only when the collar 22 is in any one of eight allowable angular orientations 0° or 360°, 45°, 90°, 135°, 180°, 225°, 270°, and 315°. Preferably, the eight surfaces 44 of the collar 22 are aligned with the eight surfaces 38 of the snout 20 to position the collar relative to the snout in a selected one of the eight orientations. Then, the collar 22 is mated with the snout 20 in the selected orientation. Respective contact between the eight surfaces 38 and the eight surfaces 44 prevents the collar 22 from being rotated about the snout 22 and thus serves to fix the collar in the selected orientation. The selected orientation provides a visible indication that serves to identify the ink supply in the bag 16 such as by color or type.

As described in the cross-referenced applications filed Aug. 16, 2001 and incorporated into this application, the collar 22 has a key slot or keyway 46 that is angular positioned in accordance with the selected orientation of the collar. The hollow needle (not shown) for piercing the septum in order to discharge an ink supply from the bag 16 when the cartridge 10 is used in an ink jet printer is mounted on a key assembly (not shown) having a key tab intended to be received in the key slot 46. The particular orientation of the key assembly must match the selected orientation of the collar 22 in order for the key tab to be received in the key slot 46.

The number of the surfaces 38 of the snout 20 and the number of the surfaces 44 of the collar 22, need not each be eight (although they must be the same number). Preferably, the number of the surfaces 38 of the snout 20 and the number of the surfaces 44 of the collar 22 fall within the range 4–12. All that is necessary is that the number of the surfaces 38 of the snout 20 and the number of the surfaces 44 of the collar 22 form similar complementary polygons.

Figure 4:
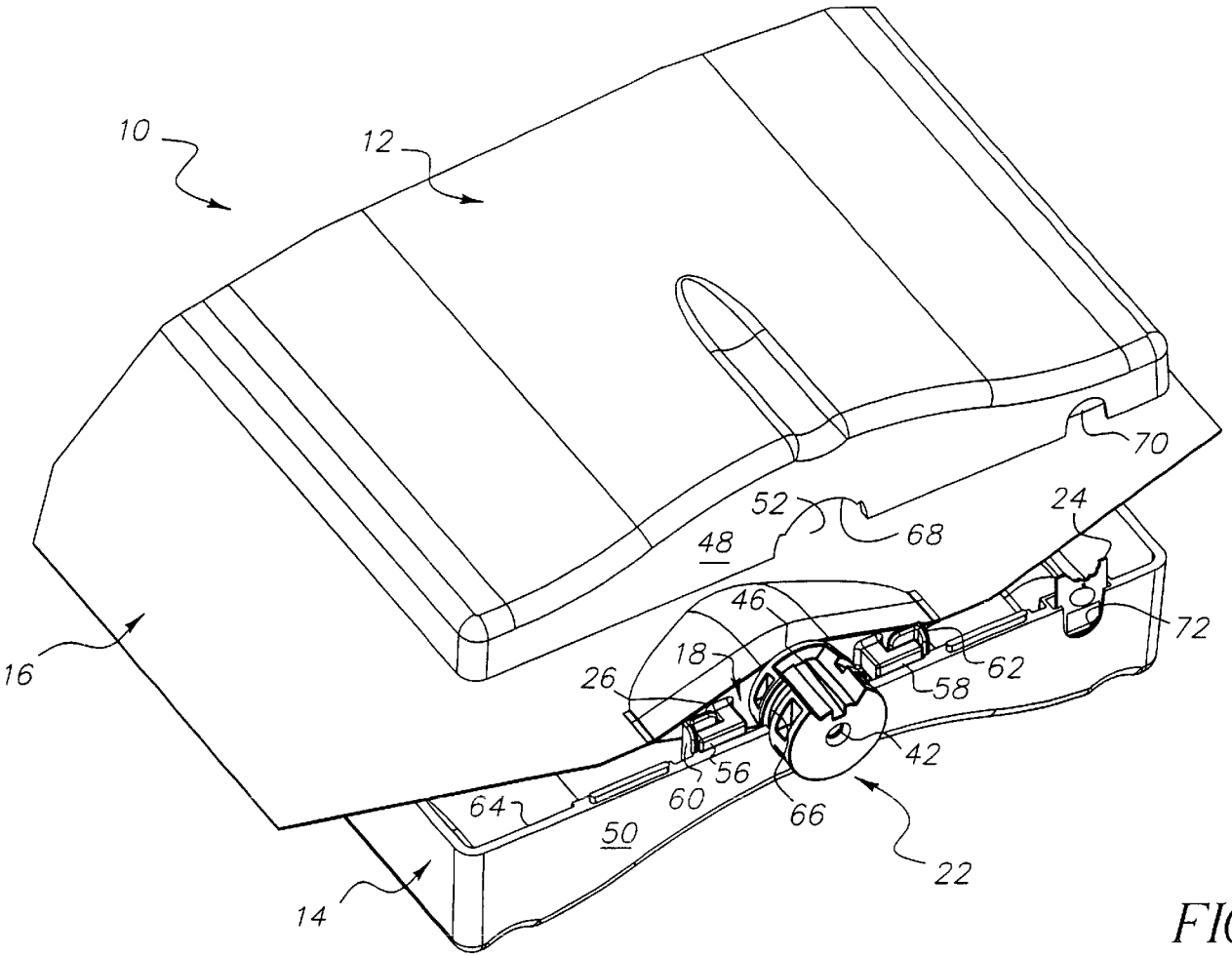
FIG. 4 is an enlargement of a bottom portion of the ink cartridge as shown in FIG. 1.
Figure 6:
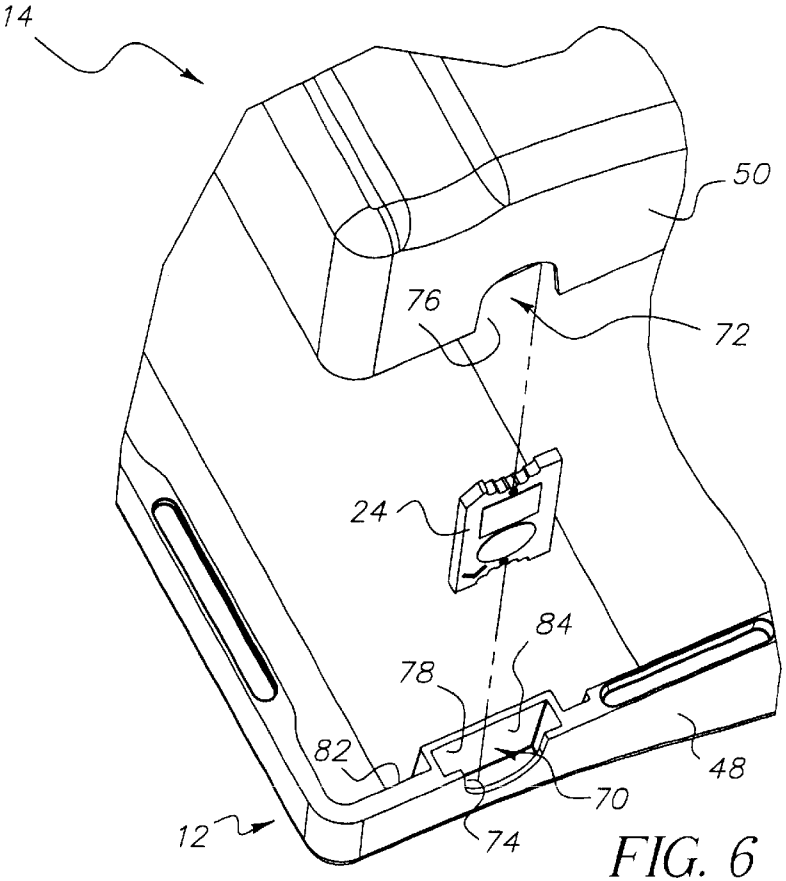
FIGS. 5 and 6 are exploded perspective views of a memory chip as it is inserted into a pocket in the ink jet cartridge.
Figure 5:
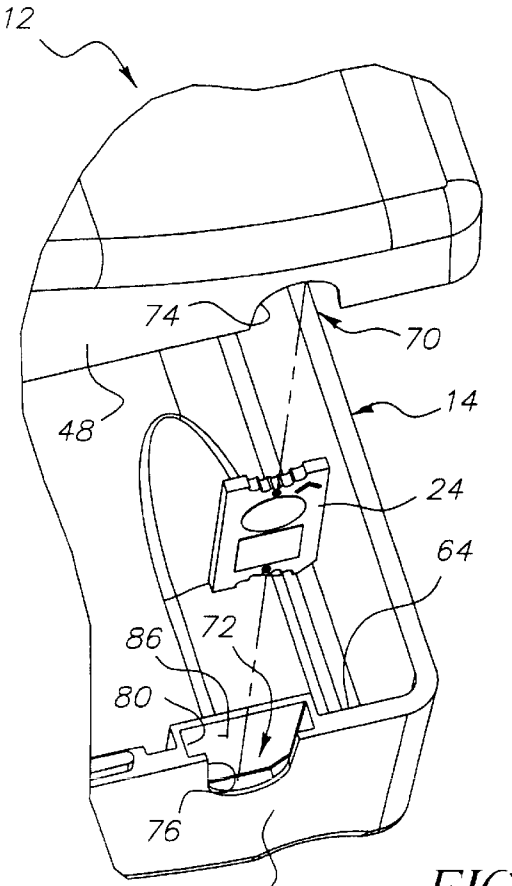

The housing halves 12 and 14 at respective bottom wall portions 48 and 50 have opening halves 52 and 54 that form a single bottom opening when the housing halves are connected together. See FIGS. 1 and 4. The fitting 18 has a pair of L-shaped engageable members or tabs 56 and 58 that project from respective areas of the face 40 (of the fitting) which are spaced from the snout 20. In a similar sense, a pair of L-shaped engageable members or tabs 60 and 62 project from an inner side 64 of the wall portion 50 and are spaced from the opening half 52. The L-shaped engageable members 56 and 58 extend in opposite directions as do the L-shaped engageable members 60 and 62. This complementary arrangement or mutual configuration permits the L-shaped member 56 to engage the L-shaped member 60 and the L-shaped member 58 to engage the L-shaped member 62 when the bag 16 is placed on the housing half 14. The bag 16 is thus secured in place. At the same time as shown in FIG. 4 an edge 65 of the opening half 54 is received in an outer peripheral groove 66 in the collar 22 to support the collar. Then, when the housing half 12 is connected to the housing half 14, an edge 68 of the opening half 52 is received in the groove 66.

When the bag 16 is emptied, it can be removed from the cartridge 10 and disposed of. All that is required is that the housing half 12 be disconnected from the housing half 14 and the L-shaped engageable members 56 and 58 be disengaged from the L-shaped engageable members 60 and 62. The collar 22 can be removed from the snout 20 if it is to be reused.

Other L-shaped engageable members can be provided on the fitting 18 and the housing half 14 in addition to the L-shaped engageable members 56 and 58 and the L-shaped engageable members 60 and 62. Also, it is not necessary that these engageable members be L-shaped. A number of known engagements or interlocks can be used instead, such as pins in holes, etc.

Pocket For Memory Chip

As shown in FIGS. 1 and 4–6, the housing halves 12 and 14 at bottom wall portions 48 and 50 have respective pocket portions 70 and 72 which include slightly smaller and larger wall opening portions 74 and 76 and sleeve or channel portions 78 and 80. Moreover, the bottom wall portion 48 at an inner side 82 and the bottom wall portion 50 at the inner side 64 have respective ink blocking shield segments 84 and 86 that project inwardly of the housing halves 12 and 14 from the inner sides. See FIGS. 5 and 6. The ink blocking shield segment 84 is an integral extension of the inner side 82 and extends across the wall opening portion 74, and the ink blocking shield segment 86 is an integral extension of the inner side 64 and extends across the wall opening portion 76. This is to isolate or seal the wall opening portions 74 and 76 from the interiors of the housing halves 12 and 14.

When the housing halves 12 and 14 are connected together, the memory chip 24 is peripheral-edge supported in the channel portions 78 and 80 to hold the memory chip in the wall opening portions 74 and 76. Also, the pocket portions 70 and 72 combine to form a single pocket including the wall opening portions 74 and 76 combining to form a single wall opening, and the ink blocking shield segments 84 and 86 abut end-to-end to seal the single wall opening. The ink supply bag 16, which is between the housing halves 12 and 14, might per chance leak ink. However, the ink blocking shield segments 84 and 86 which are then abutted end-to-end prevent any ink from entering the wall opening portions 74 and 76 and contaminating the memory chip 24.

The invention has been described in detail with particular reference to certain preferred embodiments thereof, but it will be understood that variations and modifications can be effected within the spirit and scope of the invention.

PARTS LIST

10. ink cartridge
12. housing half
14. housing half
16. ink bag
18. connector-fitting
20. snout
22. collar
24. memory chip
26. elongate opening
28. ribs
30. septum
32. ink egress opening
34. cap
36. center opening
38. eight surfaces or facets
40. face
42. center opening
44. eight surfaces or facets
46. key slot
48. bottom wall portion
50. bottom wall portion
52. opening half
54. opening half
56. L-shaped engageable member
58. L-shaped engageable member

60. L-shaped engageable member
62. L-shaped engageable member
64. inner side
65. edge
66. groove
68. edge
70. pocket portion
72. pocket portion
74. wall opening portion
76. wall opening portion
78. sleeve or channel portion
80. sleeve or channel portion
82. inner side
84. ink blocking shield segment
86. ink blocking shield segment

What is claimed is:

1. An ink cartridge comprising a pair of housing portions with respective pocket portions including wall opening portions, an ink supply bag contained in said housing portions, and a memory chip supported in said wall opening portions, is characterized in that:

said housing portions have respective ink blocking shield segments arranged at individual locations between said bag and said memory chip to prevent any ink that might leak from said bag from entering said wall opening portions and contaminating said memory chip.

2. An ink cartridge as recited in claim 1, wherein said wall opening portions are open at respective inner sides of said housing portions, and said shield segments are located at said inner sides to seal said wall opening portions.

3. An ink cartridge as recited in claim 2, wherein said shield segments are integral extensions of said inner sides.

4. An ink cartridge as recited in claim 3, wherein said shield segments project inwardly of said housing portions from said inner sides.

5. An ink cartridge as recited in claim 1, wherein said housing portions mate to form a cartridge housing, said pocket portions form a single pocket including said wall opening portions forming a single wall opening when said housing portions mate, and said ink blocking shield segments abut edge-to-edge to seal said single wall opening when said housing portions mate.

6. A method of assembling an ink cartridge to include a memory chip in a single pocket, said method comprising:

providing a pair of housing portions with respective pocket portions including wall opening portions and with respective ink blocking shield segments extending across the wall opening portions at inner sides of the housing portions;

mating the housing portions to form a cartridge housing with the pocket portions forming a single pocket including the wall opening portions forming a single wall opening and the ink blocking shield segments abutting edge-to-edge to seal the single wall opening; and including a memory chip in the single pocket as the single pocket is formed.

7. An ink cartridge comprising a pair of housing halves with respective pocket portions including wall opening portions, an ink supply bag contained in said housing halves, and a memory chip supported in said wall opening portions, is characterized in that:

said housing halves have respective ink blocking shield segments that extend across said wall opening portions at inner sides of said housing halves to prevent any ink that might leak from said bag from entering said wall opening portions and contaminating said memory chip.

8. A pair of housing halves for containing an ink supply bag and provided with respective pocket portions including wall opening portions for a memory chip, are characterized in that:

said housing halves have respective ink blocking shield segments that extend across said wall opening portions at inner sides of said housing halves to prevent any ink that might leak from an ink bag contained in said housing halves from entering said wall opening portions and contaminating a memory chip supported in said wall opening portions.

9. A pair of housing halves as recited in claim 8, wherein said housing halves mate to form a cartridge housing, said pocket portions form a single pocket including said wall opening portions forming a single wall opening when said housing halves mate, and said ink blocking shield segments abut edge-to-edge to seal said single wall opening when said housing halves mate.

10. A pair of housing halves as recited in claim 8, wherein one of said wall opening portions is larger than the other.

* * * * *